United States Patent [19]

Seidler

[11] Patent Number: 4,579,133

[45] Date of Patent: Apr. 1, 1986

[54] COSMETIC COMPACT WITH EXTENDABLE APPLICATOR

[75] Inventor: David Seidler, Forest Hills, N.Y.

[73] Assignee: Revlon, Inc., New York, N.Y.

[21] Appl. No.: 484,757

[22] Filed: Apr. 14, 1983

[51] Int. Cl.[4] ..... A45D 44/18

[52] U.S. Cl. ..... 132/85; 132/79 A

[58] Field of Search ..... 132/79, 80, 85, 88.5, 132/7

[56] References Cited

U.S. PATENT DOCUMENTS

| | | | |
|---|---|---|---|
| 1,187,423 | 6/1916 | Grant | 132/80 R |
| 1,404,256 | 1/1922 | Alden | 132/80 R |
| 1,577,479 | 3/1926 | McEvoy | 132/80 R |
| 2,796,070 | 6/1957 | Marsak | 132/85 |
| 2,830,602 | 4/1958 | Levi | 132/79 R |
| 2,951,584 | 9/1960 | Bauer | 132/79 R |
| 3,760,820 | 9/1973 | Seidler | 132/79 R |

*Primary Examiner*—Gregory E. McNeill

[57] ABSTRACT

A compact comprises a bottom container and a top housing. The container includes a front wall with an undercut section therein, a back wall, and an intermediate floor connected at an angle to the back wall. The housing includes an applicator and a key or button for extending the applicator from the housing. The button is engagable with the undercut section of the front wall of the container so that the housing is locked together with the container.

The invention also relates to a method of using the compact. The method comprises the steps of unlocking an undercut lock interconnecting the container and the housing, unlocking a snap lock interconnecting the applicator with the housing, and unlocking a wedge lock holding the container in a closed position.

19 Claims, 6 Drawing Figures

COSMETIC COMPACT WITH EXTENDABLE APPLICATOR

BACKGROUND OF THE INVENTION

1. Field of the Invention

This invention relates to a new and improved construction and design for a cosmetic compact and, in particular, for a compact with an extendable applicator and a method for using such a compact.

2. Description of the Prior Art

Basically, it has been a problem in the prior art to provide a cosmetic compact which is inexpensive, highly functional but small in size. Exemplary of the prior art are U.K. Patent Specification No. 310,139 and U.S. Pat. Nos. 2,442,541; 3,442,414 and 3,729,011.

SUMMARY AND OBJECTS OF THE INVENTION

Essentially, the present invention allows for an inexpensive plastic molded construction of a highly functional compact—and very importantly—gives the appearance of a small-sized compact but also provides a usable full-sized applicator and product volume.

A primary object of the invention is to provide a compact which has a container for a powder or cream product in the bottom thereof, a mirror integral with a lid which is attached to the compact by a living hinge, and a space above the mirror for a brush-type applicator which is extendable from a housing by a button slidable along the side wall thereof.

Another object of the invention is to provide a novel method for using a compact. The method includes three unlocking steps involving an undercut lock, a snap lock, and a wedge lock, all described in detail hereinafter.

BREIF DESCRIPTION OF THE DRAWINGS

DETAILED DESCRIPTION OF THE PREFERRED EMBODIMENT

Figure 1:
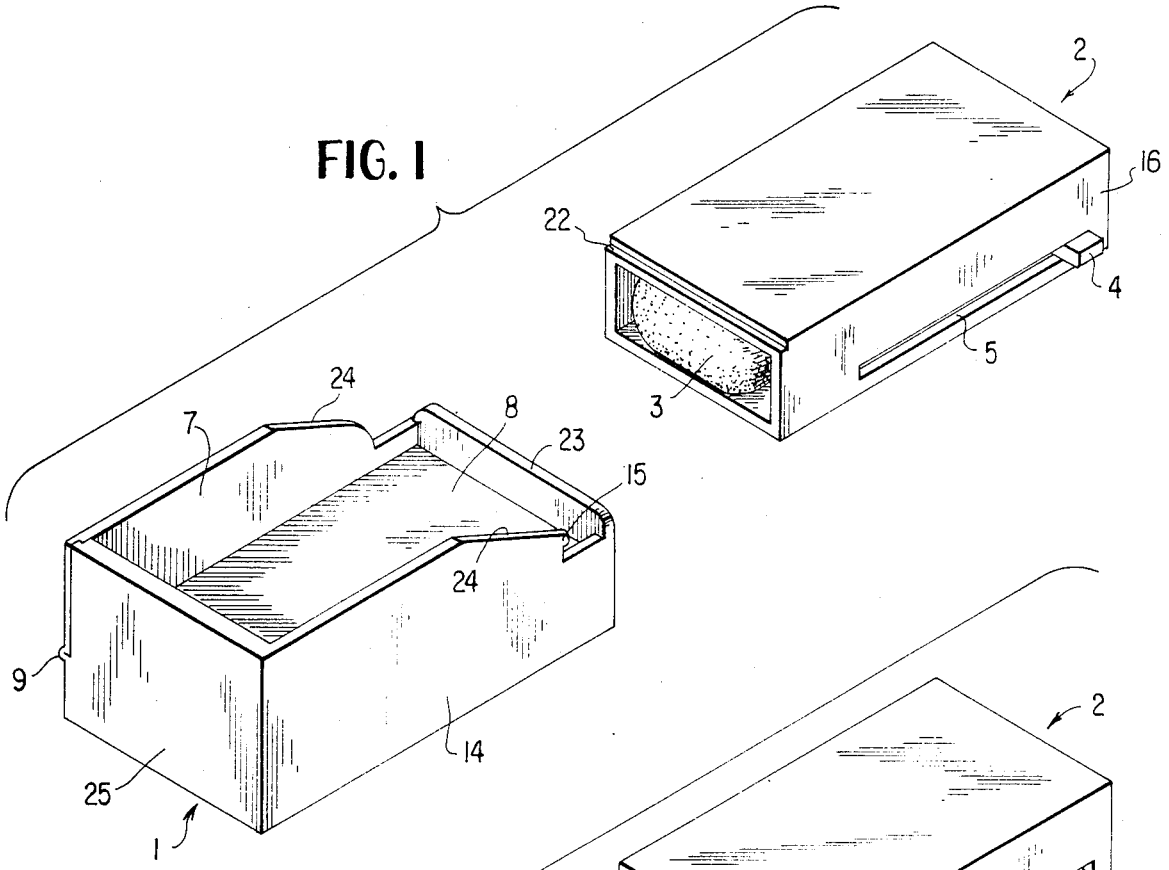
FIG. 1 is an exploded perspective view of the compact with the applicator in its housing and with the product container closed.

In FIG. 1, there is shown a compact comprising a bottom container 1 and a top applicator housing 2. Inside the housing 2 there is partially shown an applicator, preferably a brush 3, which is extendable by a key or button 4 that slides in a keyway or track 5 cut out along side wall 16 of housing 2. There is also a ledge 22 at the top edge of the opening for the brush 3. The bottom container 1 includes a side wall 27, a back wall 7 and an intermediate floor 8, the latter two being rotatable about a living hinge 9. Bottom container 1 also includes a low side wall 23 and a front wall 14 having an undercut section 15. Both back wall 7 and front wall 14 are opposite and substantially parallel to each other. Walls

7 and 14 also have truncated sections 24 sloping down to about the height of the low side wall 23.

Figure 2:
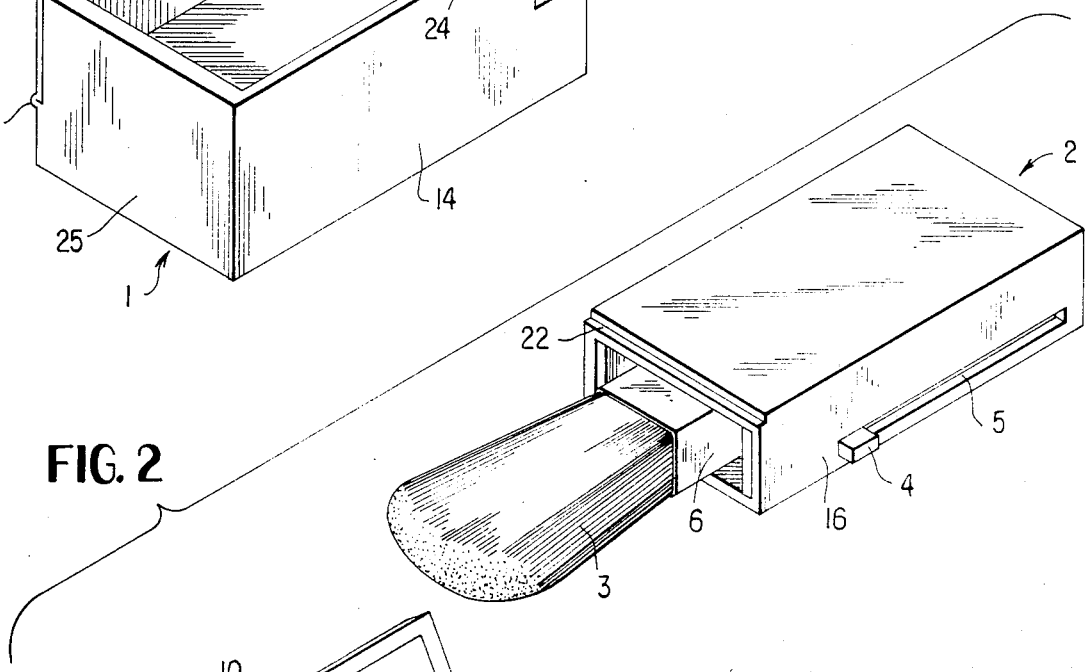
FIG. 2 is an exploded perspective view of the compact with the applicator extended from its housing and with the container opened to expose the product and the mirror ready for use.
Figure 2:
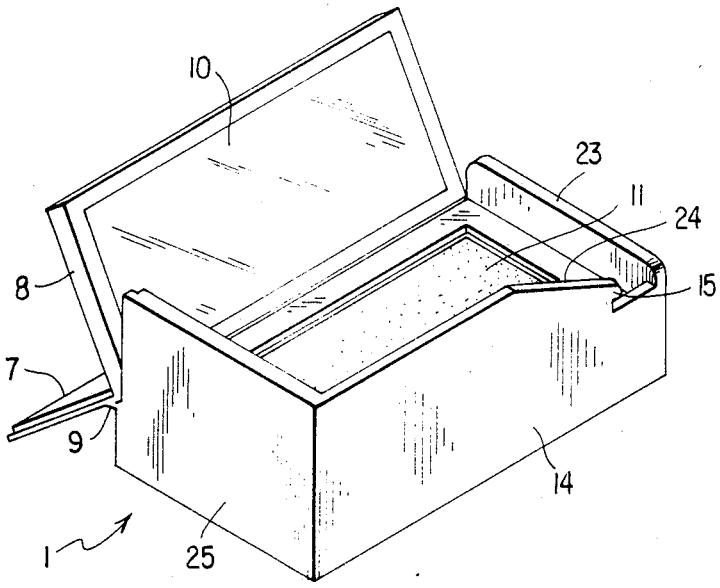

In FIG. 2, the brush 3 is shown fully extended from the housing 2. This extension of the brush 3 has been accomplished by sliding the button 4, which is attached indirectly to a ferruled base 6 of the brush 3, in the track 5 along the side wall 16 of the housing 2.

Also in FIG. 2, the bottom container 1 is shown in its open condition. Back wall 7 and intermediate floor 8, which are integrally connected to each other at about 90°, have been rotated together around the living hinge 9 so as to expose a mirror 10 and a cosmetic or powder product 11 for use. Back wall 7 acts as a finger-controlled mechanism for adjusting the angle of the mirror 10.

Figure 3:
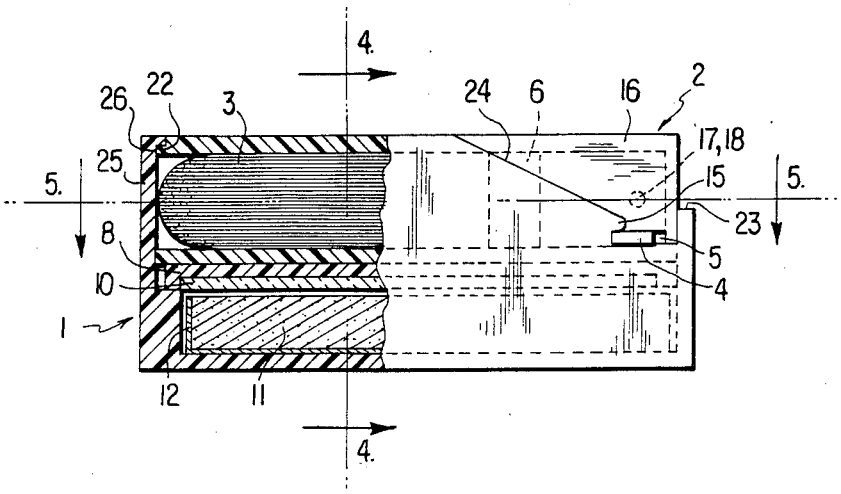
FIG. 3 is a partially broken away cross-sectional longitudinal view of the compact in its closed condition.
Figure 4:
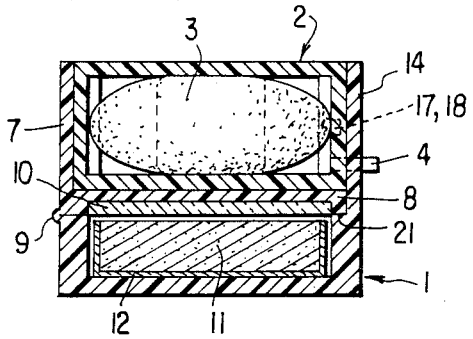
FIG. 4 is a cross-sectional side view of the compact in its closed condition.

In FIGS. 3 and 4, the internal details of the compact may be better seen. A ledge 26 under the back top edge of side wall 27 engages with the ledge 22 on the top edge of housing 2. Also, for example, it is seen that the cosmetic product 11 is held in a replacable pan 12 inside the container 1. Alternately, the cosmetic product 11 may be provided directly inside the container 1 without the use of a pan 12. However, such an arrangement is not preferred because then the cosmetic product 11 is not as easily replacable as where the product 11 is provided in the pan 12. In either embodiment, when the container 1 is in its closed position, the mirror 10 seals the product 11 against spillage and contamination of the other elements of the compact. A slight space is provided between the mirror 10 and the top of the pan 12 so that the product 11 does not directly contact the mirror 10.

Figure 5:
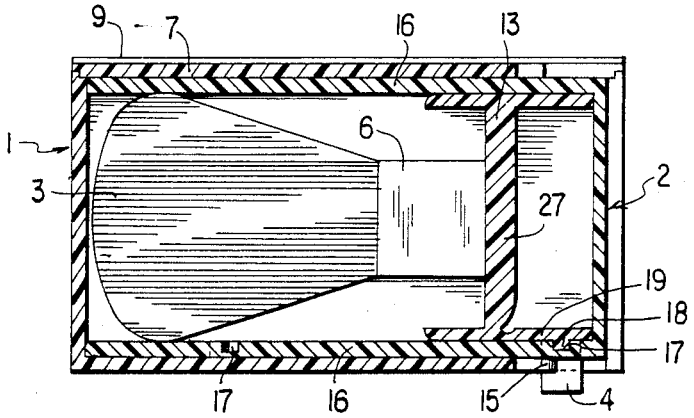
FIG. 5 is a cross-sectional top view of the compact with the applicator in its housing.
Figure 6:
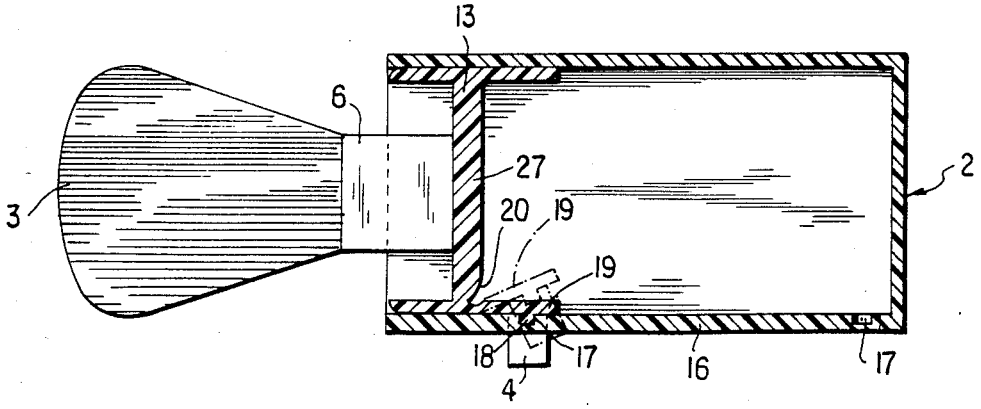
FIG. 6 is a cross-sectional top view of the compact with the applicator extended from its housing.

In FIGS. 5 and 6, the internal details of the top housing 2, from which the brush 3 is extendable, are shown. For example, it is seen that the ferruled base 6 of the brush 3 is stabilized while being held by a cross support member 27 of an I-shaped slide 13 to which button 4 is attached. Other details will be described fully during the description of the operation of the compact.

Included in the construction of the compact are three locking/unlocking features. As may be best seen in FIGS. 1 and 2, along the top of front wall 14 at the right hand side of container 1, the undercut section 15 is provided as a matching cutout for button 4 which protrudes from track 5 of housing 2. Also, as best seen in FIG. 3, ledge 22 of housing 2 engages under ledge 26 at the top edge of side wall 25 of container 1. This assembly comprises the first locking feature for container 1 and housing 2 and may be referred to as the undercut lock.

As may be best seen in FIG. 4, back wall 7 and intermediate floor 8, under which mirror 10 is attached, are rigidly molded to each other at a 90° angle and, thus, prevent the housing 2 for brush 3 from inadvertently disengaging itself. Back wall 7 and intermediate floor 8 together confine the housing 2 against front wall 14 of container 1 by a friction fit. Functionally, this second locking feature, besides securing the housing 2 inside container 1 of the compact, involves the locking of the intermediate floor 8 with its attached mirror 10 firmly in place when the compact is in a closed condition.

This second locking feature is accomplished when the free edge of the intermediate floor 8, as shown on the right hand side of FIG. 4, abuts against inside ledge 21 of container 1 and may be referred to as the wedge lock.

As may be best seen in FIGS. 5 and 6, on the inside of side wall 16 of housing 2, at least two notches 17 are cut slightly above keyway or track 5, shown best in FIGS. 1 and 2. See also notch 17 in the right hand side views of FIGS. 3 and 4. As clearly shown in FIGS. 5 and 6, a nib 18 is formed integrally with and extending from one leg 19 of the I-shaped slide 13 for engagement into and disengagement out of either one of the notches 17. A slight undercut 20 is made in the I-shaped slide 13 immediately above leg 19 so that leg 19 may easily flex nib 18 in and out of notches 17 whenever a user of the compact pushes against key or button 4. This third locking feature may be referred to as a snap lock.

The use of the compact by a person will now be described in detail. Beginning with FIG. 3 which shows the compact in its completely closed condition, the user first pushes button 4 to the right in order to begin the opening of the compact. Once the button 4 has reached the right end of track 5, the user grasps the housing 2 with the fingers at the area of both side walls 16 exposed above the truncated sections 24 of container 1 and lifts upwardly so that button 4 of housing 2 passes undercut section 15 of container 1 and ledge 22 of housing 2 disengages from ledge 26 of container 1. Thus, the housing 2 may be removed over the low side wall 23 out of the space above the intermediate floor 8 of container 1, as shown in FIG. 1. Thus, the first unlocking step has been completed.

As shown at the right hand side of FIGS. 5 and 6, button 4 is then pushed inwardly so that nib 18 disengages from notch 17. The undercut section 20 allows leg 19 to flex backwardly. At this point, the second unlocking step has been completed.

The user propels brush 3 to the left, as shown in FIG. 6, by pushing button 4 along track 5 cut in side walls 16 of housing 2, as shown in FIG. 2, until button 4 is stopped at the left end of track 5, thus leaving brush 3 fully extended. Referring back to FIG. 6, the brush 3 will be stabilized in its movement because its ferruled base 6 is held by cross support member 27 of the I-shaped slide 13. Also, brush 3 will be locked in its fully extended position when the user releases the button 4 in order to allow leg 19 to flex nib 18 back into notch 17 at the left.

Referring now to FIG. 1, the user pushes against the inside of back wall 7 so that intermediate floor 8 disengages from inside ledge 21, shown only in FIG. 4. As shown in FIG. 2, both back wall 7 and intermediate floor 8, which are preferably integrally molded together, are pivoted rearwardly about 90° or more around living hinge 9 to the open position. Thus, the third unlocking step has been completed.

Mirror 10, which is attached to the underside of intermediate floor 8, and cosmetic product 11 are now both fully exposed for use. The person holding the housing 2 dabs the end of brush 3 into the product 11 and applies the cosmetic wherever desired. The compact may be closed and relocked by following in reverse the three steps involving the snap lock, the wedge lock, and the undercut lock.

The illustrations and the written description of this compact are not intended to limit the construction and design of the invention. There are many other variations and modifications that may be derived from the disclosed basic concepts which are embraced by the appended claims.

I claim:

1. A compact comprising:

a container for holding cosmetics including one wall with notch therein, another wall opposite and substantially parallel to the one wall, and an intermediate floor connected at an angle to the other wall; and a housing including an applicator and a means for extending the applicator from the housing;

said extending means being engagable with the notch of the one wall of the container so that the applicator housing is locked together with the container.

2. The compact, according to claim 1, further comprising:

hinge means, formed in the container, for rotating the other wall and the intermediate floor thereabout.

3. The compact, according to claim 1, further comprising:

a mirror integrally attached to the intermediate floor of the container.

4. The compact, according to claim 1, further comprising:

first ledge means, formed in the housing, and second ledge means, formed in the container, for aiding the locking down of the applicator housing in a space provided above the intermediate floor of the container.

5. The compact, according to claim 1, further comprising:

pan means for holding a cosmetic product in the container.

6. The compact, according to claim 1, further comprising:

track means, arranged in one wall of the applicator housing, for allowing the extending means to be propelled therealong.

7. The compact, according to claim 1, further comprising:

slide means, arranged inside the applicator housing, for interconnecting the applicator with the extending means.

8. The compact, according to claim 7, further comprising:

second notch means, arranged inside the applicator housing, for engaging with the slide means in a locking manner.

9. The compact, according to claim 8, further comprising:

nib means, arranged on the slide means, for engaging with the second notch means in a locking manner.

10. The compact, according to claim 9, wherein: said slide means is I-shaped, includes a leg means for carrying the nib means, and also includes a cross support means for stabilizing the applicator.

11. The compact, according to claim 10, wherein:

said cross support means includes an undercut means for allowing the leg means to flex backwardly whenever the extending means is pushed upwardly.

12. The compact, according to claim 1, further comprising:

truncated section means, cut into both the one wall and the other wall, for allowing the applicator housing to be grasped; and third ledge means, formed in the container, for locking the intermediate floor down in a wedge-like manner.

13. A compact comprising:

a container including a low side wall, two opposite and substantially parallel walls having truncated sections sloping toward the low side wall, another higher side wall opposite and substantially parallel to the low side wall, an intermediate floor, and a space provided above the intermediate floor between the four walls; and a housing including an applicator, means for locking the housing together with the container in the space provided above the intermediate floor between the four walls, and side walls having an area exposed above the truncated sections of the two walls of the container so that the housing may be grasped for removal from the space provided above the intermediate floor between the four walls of the container;

said intermediate floor being pivotable from a first position perpendicular to the walls wherein it seals closed a space framed by the walls to a second positon wherein the space is open.

14. A compact, according to claim 13, wherein:

said higher side wall of the container has a ledge under its top edge; and one of said two walls having truncated sections also has a notch.

15. A compact, according to claim 13, wherein:

said locking means on the housing includes means for extending the applicator, said extending means being engagable with the notch of the one of said two walls having truncated sections, and ledge means, arranged along one edge of an opening for the applicator, for engaging with the ledge under the top edge of the higher side wall of the container.

16. A compact and applicator, comprising:

a container having a first section for holding cosmetics and a section for holding the applicator, a housing for the applicator and a means for retracting and extending the applicator from and into the housing;

cover means pivotally attached to the container for sealing the first section of the container;

notch means in said second section of the container for engaging with the housing to retain the housing within the second section of the container in such a position so as to retain the cover means in a sealed position with the first section.

17. The compact and applicator according to claim 16, wherein the cover means includes a mirror.

18. The compact and applicator according to claim 17, wherein the cover means includes a wall of the second section of the container.

19. The compact and applicator according to claim 18, wherein the mirror and wall are arranged perpendicularly with respect to each other.

* * * * *